US009217186B2

(12) United States Patent
Barrow et al.

(10) Patent No.: US 9,217,186 B2
(45) Date of Patent: Dec. 22, 2015

(54) ALLOY STEEL

(75) Inventors: Andrew T W Barrow, Hereford (GB); Harshad K D H Bhadeshia, Cambridge (GB); Martin J. Rawson, Derby (GB); Paul O Hill, Derby (GB)

(73) Assignee: ROLLS-ROYCE PLC, London (GB)

( * ) Notice: Subject to any disclaimer, the term of this patent is extended or adjusted under 35 U.S.C. 154(b) by 374 days.

(21) Appl. No.: 13/232,384

(22) Filed: Sep. 14, 2011

(65) Prior Publication Data

US 2012/0080124 A1 Apr. 5, 2012

(30) Foreign Application Priority Data

Oct. 5, 2010 (GB) ..... 1016731.0

(51) Int. Cl.

| | |
|---|---|
| ***C22C 38/44*** | (2006.01) |
| ***C21D 1/25*** | (2006.01) |
| ***C21D 6/00*** | (2006.01) |
| ***C22C 38/50*** | (2006.01) |
| ***C22C 38/52*** | (2006.01) |
| ***C22C 38/06*** | (2006.01) |

(52) U.S. Cl.

CPC *C21D 1/25* (2013.01); *C21D 6/004* (2013.01); *C21D 6/007* (2013.01); *C22C 38/06* (2013.01); *C22C 38/44* (2013.01); *C22C 38/50* (2013.01); *C22C 38/52* (2013.01); *C21D 2211/004* (2013.01); *C21D 2211/008* (2013.01)

(58) Field of Classification Search

CPC ..... C22C 38/44

USPC ..... 148/320, 325, 327, 335, 579, 605, 611, 148/621; 420/8, 34, 43, 52, 53

See application file for complete search history.

(56) References Cited

U.S. PATENT DOCUMENTS

| | | | |
|---|---|---|---|
| RE36,382 | E | 11/1999 | Hultin-Stigenberg |
| 2003/0049153 | A1 | 3/2003 | Martin et al. |
| 2004/0206425 | A1 | 10/2004 | Raymond et al. |
| 2008/0314480 | A1 | 12/2008 | Wright et al. |

FOREIGN PATENT DOCUMENTS

| | | | | |
|---|---|---|---|---|
| EP | 1997921 | A2 * | 12/2008 | ..... C22C 19/00 |
| GB | 0405650 | A | 2/1934 | |
| GB | 2 423 090 | A | 8/2006 | |
| JP | A-63-134648 | | 6/1988 | |

(Continued)

OTHER PUBLICATIONS

Jan. 17, 2011 Great Britain Search Report issued in Application No. GB1016731.0.

(Continued)

*Primary Examiner* — Brian Walck

(74) *Attorney, Agent, or Firm* — Oliff PLC

(57) ABSTRACT

The invention provides an alloy steel having the following composition: Ni 5-14 wt %; Cr 4-16 wt %; Co 7-14 wt %; Mo 1-5 wt %; W 0-5 wt %; Ti 0-0.8 wt %; Al 0.1-3 wt %; the balance being Fe save for incidental impurities. This provides an ultra-high strength corrosion resistant steel with good toughness, which does not significantly creep at temperatures up to 450° C. The high quantity of alloying to elements, particularly chromium, also gives the alloy good corrosion resistance. The alloy is particularly suitable for main shafts of gas turbine engines.

5 Claims, 1 Drawing Sheet

(56) References Cited

FOREIGN PATENT DOCUMENTS

Figure 1A:
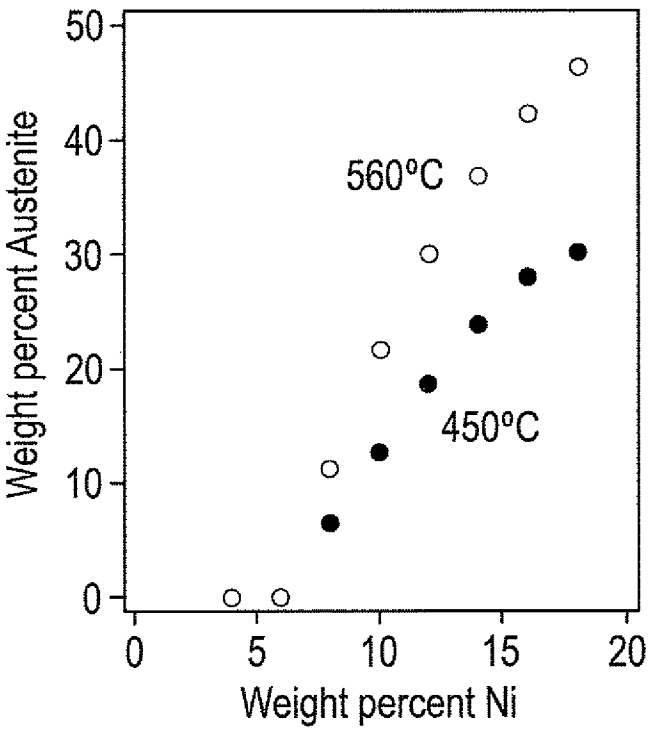

| | | |
|---|---|---|
| JP | A-2000-248340 | 9/2000 |
| JP | A-2002-285290 | 10/2002 |

OTHER PUBLICATIONS

European Search Report issued in European Patent Application No. 11 18 1257 dated Dec. 1, 2011.

* cited by examiner

ALLOY STEEL

This invention relates to alloy steels, and is particularly applicable to alloy steels suitable for making shafts for gas turbine engines.

In a three-shaft gas turbine engine, the fan (sometimes referred to as the low-pressure compressor) is driven by the low-pressure turbine via the low-pressure shaft. The low-pressure shaft typically comprises two shafts—a low-pressure turbine (LPT) shaft and a low-pressure compressor (LPC) or fan shaft. The LPT and LPC shafts are joined coaxially and end-to-end by a helical spline joint.

The LPT shaft is commonly made from two separate sections, of two different materials, which are inertia welded together, because no single material can provide the necessary mechanical properties along the whole length of the low-pressure turbine shaft.

The spline region of the LPT shaft operates at a relatively low temperature (about 150° C.), but this region requires a challenging combination of mechanical properties—high torque-carrying capability, high ultimate tensile strength (in case of a fan blade release), high 0.2% proof stress (for bird strike) and good fatigue strength. This section of the LPT shaft is therefore made from an alloy such as AerMet® 100. However, this alloy is not suitable for use at elevated temperatures (above 350° C.) for extended periods of time because of over-aging of the carbide structure, which significantly reduces the yield and tensile strengths and has an adverse effect on the creep resistance.

AerMet® 100 also has a high Ni content (about 11 wt %) to increase the hardenability of the alloy; this facilitates the production of large components such as shafts. Ni is a known austenite stabiliser and it has been shown to lower the temperature at which austenite is stable, reducing the Ae1 and Ae3 temperatures. Therefore, alloys with a high Ni content are not used at high service temperatures because of austenite reversion, which has been shown to reduce material strength.

The rear part of the LPT shaft is not subjected to the torque loads seen by the spline, but it may reach temperatures of up to 450° C. for extended periods. This section of the LPT shaft is therefore made from an alloy such as Super-CMV. This alloy does not have the torque-carrying capability or the fatigue strength to be used in the low-temperature spline region of the shaft, but the microstructure is relatively stable up to 450° C. giving the alloy good thermal stability and creep capability.

The manufacture of the low-pressure turbine shaft is complicated by the need to fabricate it from sections made from two different materials. The presence of a welded joint increases cost and manufacturing time and also means that the heat affected zone and residual stresses need to be considered in the design process.

The inventors have developed an alloy steel having improved properties suitable for all regions of the low-pressure turbine shaft, so that the shaft can be made in one piece. The alloy is also suitable for other applications with similarly demanding operational requirements.

The invention provides an alloy steel as set out in the claims.

Exemplary embodiments of the invention will now be described, by way of example only, so that it may be more clearly understood how the invention is to be put into effect. Reference will be made to the accompanying drawing in which:

FIG. 1 shows, for two exemplary alloys according to the invention, the calculated equilibrium weight percentage of austenite as a weight percentage of nickel, at two different temperatures.

The inventors have developed an alloy that can meet the strength, fatigue and creep resistance requirements of the entire LPT shaft. The alloy is strengthened by the precipitation of intermetallic compounds that can either be q-phase, when alloyed with Ti, or β-phase, when alloyed with Al.

Typically, the Ni content of the alloy is below 10 wt %, which is lower than for similar, known alloys. The alloy is designed to achieve a high hardenability by replacing some of the Ni with Cr. In this alloy system, Cr acts to raise the Ae1 temperature preventing austenite reversion during tempering or service at elevated temperatures. Cr has the added benefit of providing corrosion resistance to the alloy, at levels above about 8 wt %, which is preferable for shaft applications. Typically, the total of Ni and Cr in the alloy is between 10-20 wt %.

Cr is normally used instead of Co in such alloys, for cost reasons; an excessive amount of either can reduce the ductility of the alloy. In the alloy according to the invention, both Co and Cr are used to provide corrosion resistance (Cr), a martensite-start (Ms) temperature higher than ambient temperature (Cr decreases it, Co is neutral), and to stabilise the martensite structure (both Cr and Co).

In addition, the alloy according to the invention is designed to contain Laves phase. It is the replacement of Ni by Cr which favours the formation of this phase, along with the addition of Mo and W. The phase is thermodynamically stable up to the operating temperature of the LPT shaft, resisting coarsening and growth.

In a first aspect, the invention provides an alloy steel having the following composition (all ranges being in wt %):

| | |
|---|---|
| Ni | 5-14 |
| Cr | 4-16 |
| Co | 7-14 |
| Mo | 1-5 |
| W | 0.1-5 |
| Ti | 0-0.8 |
| Al | 0.1-3 |

the remainder being Fe and incidental impurities.

Table 1 shows two exemplary compositions for an alloy according to the invention, indicated as Alloy 9 and Alloy 2. All FIGURES are in wt %, The preferred compositions are shown in the second and fourth columns, but it is anticipated that the benefits of the invention could be realised with compositions in the ranges shown in the third and fifth columns.

| | Alloy 1 | | Alloy 2 | |
|---|---|---|---|---|
| Element | Preferred | Range | Preferred | Range |
| Ni | 9.8-10.2 | 8-12 | 6.8-7.2 | 5-9 |
| Cr | 7.8-8.2 | 6-10 | 9.8-10.2 | 8-12 |
| Co | 8.1-8.5 | 7-10 | 8.1-8.5 | 7-10 |
| Mo | 2.7-2.9 | 2-4 | 2.7-2.9 | 2-4 |
| W | 2.4-2.6 | 2-3 | 2.4-2.6 | 2-3 |
| Ti | 0.45-0.55 | 0.3-0.7 | <0.01 | <0.01 |
| Al | 0.15-0.25 | 0.1-0.3 | 1.65-1.85 | 1-2.5 |
| Fe and incidental impurities | Remainder | Remainder | Remainder | Remainder |

The composition has been designed to limit the formation of austenite to a maximum of 5 vol % during tempering and eliminate it as an equilibrium phase at the simulated service temperature. This is achieved through specific combination of Cr, Ni and Co within the alloy designed using thermodynamic calculations.

The absence of C allows a Cr— and Ni-rich martensitic structure to form on slow cooling from austenitisation temperature without the requirement for forced cooling or quenching. This microstructure has been shown to have high fracture and impact toughness properties. The addition of Al and Co increases the martensite start and finish temperatures such that the transformation is completed above room temperature eliminating the requirement for a cryogenic treatment.

The Laves phase is stable up to about 900° C., existing in equilibrium with the ferrite and martensite. The Laves phase nucleates from the austenite during the austenitisation heat treatment. Due to the stability of the Laves phase, exploiting its precipitation from the austenite allows a shorter tempering to achieve the desired microstructure that imparts strength, fatigue and creep resistance.

A suitable austenitisation temperature for alloys according to the invention is 760° C.-820° C., and preferably in the range 760° C.-790° C. The time for austenitisation will depend on the size of the component, and this limits the minimum austenitisation temperature. The maximum austenitisation temperature is governed by the need to avoid the formation of delta ferrite. The relatively low austenitisation temperature, in comparison with known alloys, favours the precipitation of the Laves phase during austenitisation and also promotes the formation of small austenite grains.

Following austenitisation, the alloy is air cooled to below the martensite finish temperature (which will be above ambient temperature, as noted above). Because of the hardenability of these alloys, it is not necessary to control to a minimum cooling rate, and cooling at 5° C./min will produce a fully martensitic structure.

Following cooling, the alloy is subjected to ageing heat treatment or tempering.

For alloy 1, a suitable temperature range is 400° C.-500° C., and preferably 470° C.-485° C. The maximum temperature is selected to prevent austenite reversion, and the minimum temperature to control the q-phase size. The aim is to achieve semi-coherent particles that provide coherency strains and Orowan strengthening.

For alloy 2, a suitable temperature range is 450° C.-600° C., and preferably 540° C.-580° C. The maximum temperature is selected to prevent austenite reversion, and the minimum temperature to control the 3-phase size. Ageing at 560° C. for 5 hours has been shown to give slight over-ageing.

During tempering, for 5-25 hours depending on the combination of properties required, a fine dispersion of Ti-rich, n-phase ($Ni_3Ti$) or Ni-rich, β-phase (NiAl) particles nucleate from the martensite structure. These particles, which are no larger than 10 nm, give an excellent combination of mechanical properties in the tempered condition (Tables 2, 3 & 4). These intermetallic phases have been chosen because they are kinetically and thermodynamically favourable for the combination of mechanical properties and microstructural stability required in the alloy. The stability of the Laves phase is such that their size remains unchanged during tempering.

Figure 1B:
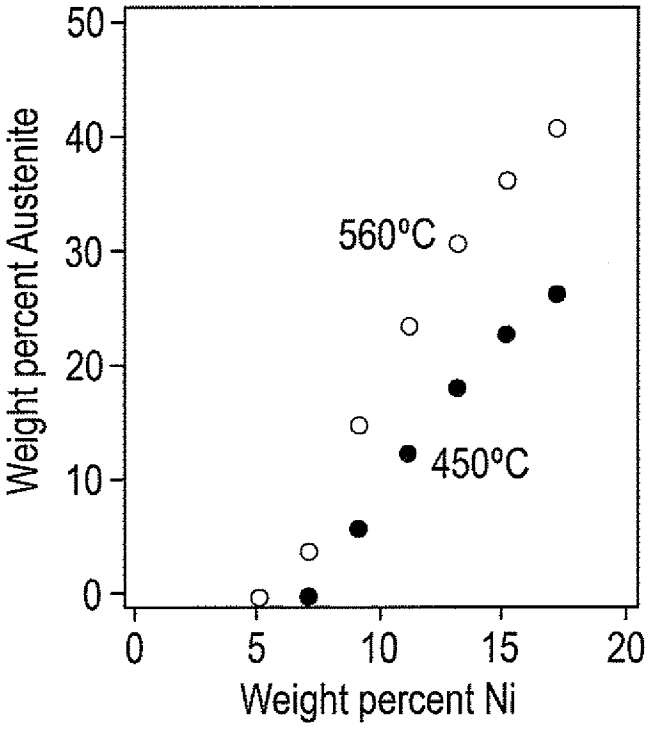

FIG. 1 shows the equilibrium amount of austenite at 450° C. and 560° C., for the two exemplary alloys. FIG. 1*a* relates to Alloy 1, in which Ni+Cr=18 wt %; FIG. 1*b* relates to Alloy 2, in which Ni+Cr=17 wt %.

Tables 2, 3 and 4 show the tensile, fatigue and creep properties of alloys according to the invention at room temperature and at 450° C.

Table 2 shows tensile properties after tempering, for the example alloys 1 and 2.

| | Temperature/ ° C. | YS/MPa | UTS/MPa | Elongation/% |
|---|---|---|---|---|
| Alloy 1 | 25 | 1935 | 1965 | 8 |
| Alloy 1 | 450 | 1250 | 1460 | 9 |
| Alloy 2 | 25 | 1710 | 1750 | 12 |
| Alloy 2 | 450 | 1240 | 1280 | 14 |

Table 3 shows tensile properties after tempering and thermal exposure at 450° C. for 3000 hours, for the example alloys 1 and 2.

| | Temperature/ ° C. | YS/MPa | UTS/MPa | Elongation/% |
|---|---|---|---|---|
| Alloy 1 | 25 | 1735 | 1865 | 10 |
| Alloy 1 | 450 | 1180 | 1250 | 12 |
| Alloy 2 | 25 | 1960 | 1995 | 8 |
| Alloy 2 | 450 | 1315 | 1320 | 15 |

Table 4 shows fatigue properties (R=0) for alloy 2 at room temperature and at 450° C.

| Temperature/° C. | Stress/MPa | Fatigue life/Cycles |
|---|---|---|
| 25 | 1400 | 127262 |
| 450 | 1200 | 167000 |

Table 5 shows creep properties (TPS=0.5%) for alloy 2 at 450° C. and at 475° C.

| Temperature/° C. | Stress/MPa | Creep life/h |
|---|---|---|
| 450 | 700 | 2315 |
| 475 | 700 | 330 |

Trials have demonstrated that this alloy has good corrosion resistance and pitting resistance. The alloy compared favourably with commercially available martensitic stainless steels such as 17-4PH in such tests as long term atmospheric corrosion testing, potentiodynamic polarization measurements and Evan's drop testing. Most of the results are qualitative but the potentiodynamic polarization measurements provide quantitative information on a material's response to a corrosive environment, giving an indication of the materials pitting resistance.

Table 6 shows the potentiodynamic polarization measurements for alloy 2 compared with known alloys.

| Material | Potential at which breakdown occurs Ev |
|---|---|
| Alloy 2 | 0.23987 |
| 17-4PH | 0.10693 |
| AerMet( ®) 100 | −0.27332 |

The alloy potential where breakdown and pitting occurs was higher compared to 17-4PH, and much higher compared to the current shaft material AerMet® 100, which shows that the alloy will be less susceptible to corrode and pit in service.

The invention therefore provides a high strength corrosion resistant steel with good toughness, which does not significantly creep at temperatures up to 450° C. The absence of C allows a Cr- and Ni-rich martensitic structure to form on slow cooling from austenitisation temperature. The Laves phase is stable up to 900° C. During tempering, a fine dispersion of Ti-rich $Ni_3Ti$ or Ni-rich NiAl particles nucleate from the martensite structure. These particles give an excellent combination of mechanical properties—strength, toughness, creep resistance and corrosion resistance—in the tempered condition. The stability of the Laves phase is such that their size remains unchanged during tempering giving the alloy good creep resistance. The high quantity of alloying elements, particularly chromium, also gives the alloy good corrosion resistance.

Good fatigue resistance is achieved by the strong microstructure and the clean vacuum melt to reduce the size and quantity of non-metallic inclusions and residual impurities. Good toughness is achieved through the addition of nickel, which forms a tough martensite.

Creep resistance and high temperature strength is achieved through specific combination of Cr, Ni and Co within the alloy, designed using thermodynamic calculations, to prevent austenite reversion during exposure to elevated temperatures.

Corrosion resistance is achieved through chromium, nickel and molybdenum alloy additions which form a passive oxide layer and have been shown to prevent the formation of pits.

Although the invention has been described in the context of an LPT shaft for a three-shaft gas turbine engine, it will be appreciated that the invention may equally well be applied in other shafts, in gas turbine engines of other types, or indeed in any application in which a component is required to meet particularly challenging operational requirements.

The invention claimed is:

1. A turbine shaft comprising an alloy steel consisting essentially of the following composition: Ni 5-9 wt %; Cr 8-12 wt %; Co 7-10 wt %; Mo 2-4 wt %; W 2-3 wt %; Ti<0.01 wt %; Al 1-2.5 wt %; the balance being Fe save for incidental impurities.

2. The turbine shaft comprising an alloy steel as claimed in claim 1, the alloy steel consisting essentially of the following composition: Ni 6.8-7.2 wt %; Cr 9.8-10.2 wt %; Co 8.1-8.5 wt %; Mo 2.7-2.9 wt %; W 2.4-2.6 wt %; Ti<0.01 wt %; Al 1.65-1.85 wt %; the balance being Fe save for incidental impurities.

3. The turbine shaft comprising an alloy steel as claimed in claim 1, in which the total wt % of Ni and Cr is between 13 and 20.

4. A method of making a turbine shaft as claimed in claim 1, the method comprising the step of performing an austenitisation heat treatment on the alloy steel at a temperature between 760° C. and 820° C.

5. A method as claimed in claim 4, the method comprising the step of performing an austenitisation heat treatment on the alloy steel at a temperature between 760° C. and 790° C.

* * * * *